US010927833B2

(12) United States Patent
Peet

(10) Patent No.: US 10,927,833 B2
(45) Date of Patent: Feb. 23, 2021

(54) INTEGRATED ECCENTRIC MOTOR AND PUMP ASSEMBLY

(71) Applicant: Schaeffler Technologies AG & Co. KG, Herzogenaurach (DE)

(72) Inventor: Brian Peet, Akron, OH (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 305 days.

(21) Appl. No.: 15/979,474

(22) Filed: May 15, 2018

(65) Prior Publication Data

US 2019/0353161 A1 Nov. 21, 2019

(51) Int. Cl.

| | |
|---|---|
| ***F04C 2/10*** | (2006.01) |
| ***F04C 15/06*** | (2006.01) |
| ***F04C 15/00*** | (2006.01) |

(52) U.S. Cl.

CPC ..... *F04C 15/008* (2013.01); *F04C 2/10* (2013.01); *F04C 15/0065* (2013.01); *F04C 15/06* (2013.01); *F04C 2240/40* (2013.01)

(58) Field of Classification Search

None

See application file for complete search history.

(56) References Cited

U.S. PATENT DOCUMENTS

| | | | | |
|---|---|---|---|---|
| 3,873,248 | A | 3/1975 | Johnson | |
| 5,145,329 | A | 9/1992 | Zumbusch et al. | |
| 6,109,887 | A | 8/2000 | Takura et al. | |
| 6,769,889 | B1 * | 8/2004 | Raney | F04C 2/102 384/278 |
| 7,695,260 | B2 * | 4/2010 | Holtzapple | F01C 1/103 418/104 |
| 9,581,156 | B2 * | 2/2017 | Torii | F04C 2/14 |
| 9,657,734 | B2 * | 5/2017 | Holtzapple | F01C 19/025 |
| 2006/0039815 | A1 | 2/2006 | Chertok et al. | |
| 2006/0279155 | A1 * | 12/2006 | Holtzapple | F01C 11/004 310/168 |
| 2008/0159885 | A1 * | 7/2008 | Kameya | F04C 2/102 417/410.4 |
| 2010/0003152 | A1 * | 1/2010 | Holtzapple | F01C 1/104 418/61.3 |
| 2012/0164009 | A1 * | 6/2012 | Sakata | F04C 2/084 417/410.4 |

(Continued)

FOREIGN PATENT DOCUMENTS

| | | | |
|---|---|---|---|
| KR | 10-2014-0106581 | A | 9/2014 |
| WO | 2008046005 | A2 | 4/2008 |

*Primary Examiner* — Peter J Bertheaud
*Assistant Examiner* — Geoffrey S Lee

(57) ABSTRACT

A pump, including: inner gerotor; a crankshaft; an outer gerotor; an inlet assembly with inlet ports; an outlet assembly with outlet ports; and magnetic actuators. The inner gerotor includes lobes and a central opening. The crankshaft: passes through the central opening; is rotatable about an axis of rotation; and includes a first longitudinal axis not co-linear with the axis of rotation. The outer gerotor includes recesses. The magnetic actuators are sequentially energized to create magnetic fields to displace the inner gerotor with respect to the crankshaft to: displace a first lobe out of a first recess and draw fluid through an inlet port into the first recess; and displace a second lobe into a second recess and expel second fluid out of the second recess and through an outlet port.

20 Claims, 13 Drawing Sheets

(56) References Cited

U.S. PATENT DOCUMENTS

| | | | | |
|---|---|---|---|---|
| 2014/0119963 | A1 | 5/2014 | Hadar et al. | |
| 2015/0267702 | A1* | 9/2015 | Holtzapple | F01C 1/103 418/15 |
| 2017/0321698 | A1* | 11/2017 | Holtzapple | F04C 27/004 |
| 2017/0328362 | A1* | 11/2017 | Hemphill | F04C 15/008 |

* cited by examiner

INTEGRATED ECCENTRIC MOTOR AND PUMP ASSEMBLY

TECHNICAL FIELD

The present disclosure relates to an integrated eccentric motor and pump with a separate crankshaft passing through an eccentric inner gerotor and rotatable with respect to the inner gerotor. The integrated eccentric motor and pump includes modular magnetic actuators and axially overlapping input and output shutter plates fixed to the crankshaft.

BACKGROUND

Commonly owned U.S. Patent Application Publication 2017/0328362 describes an integrated eccentric motor and pump with: a rotor including radially outwardly extending protrusions; an inlet guide fixed to the rotor; an outlet guide fixed to the rotor; and a stator with spaces and integral electrical windings radially aligned with the spaces. An axis of rotation for the rotor is not co-linear with a longitudinal axis for the outer gerotor. For each space, a single electrical winding is energized to draw a protrusion into the space, rotating the rotor eccentrically (with respect to the stator). The rotation of the rotor causes the protrusions to displace out of and into the spaces, drawing fluid into and expelling the fluid from the spaces, respectively.

The inlet and outlet guides are centered about the axis of rotation, rather than about the longitudinal axis. Therefore, the eccentric rotation of the rotor causes the radially outward circumference of the inlet guide and/or the outlet guide to engage the stator with a normal force, resulting in a locking-load condition that can jam the inlet guide and/or the outlet guide against the stator, blocking rotation of the rotor. Further: it is difficult to assemble the integral electrical windings; and the spaces are not fully sealed, enabling fluid from the pump to bathe the windings. Also, there is no restriction to the physical travel path of the rotor, enabling the rotor to unpredictably react to magnetic or shock load to the pump.

SUMMARY

According to aspects illustrated herein, there is provided a pump, including: an inner gerotor; a crankshaft; an outer gerotor; an inlet cover assembly; an outlet cover assembly; and magnetic actuators. The inner gerotor includes: a plurality of lobes and a central opening. The crankshaft: passes through the central opening; is rotatable about an axis of rotation; and includes a first longitudinal axis not co-linear with the axis of rotation. The outer gerotor is located radially outwardly of the inner gerotor and includes a plurality of recesses. The inlet cover assembly including a plurality of inlet ports. The outlet cover assembly includes a plurality of outlet ports. The plurality of magnetic actuators is arranged to be energized in sequence to create magnetic fields. The magnetic fields are arranged to displace the inner gerotor with respect to the axis of rotation: to displace a first lobe, included in the plurality of lobes, out of a first recess, included in the plurality of recesses, and draw first fluid through a first inlet port, included in the plurality of inlet ports, into the first recess; and to displace a second lobe, included in the plurality of lobes, into a second recess, included in the plurality of recesses, and expel second fluid out of the second recess and through a first outlet port included in the plurality of outlet ports.

According to aspects illustrated herein, there is provided a pump, including: an inner gerotor; a cylindrical crankshaft; an outer gerotor; an inlet cover assembly; an outlet cover assembly; and magnetic actuators. The outer gerotor includes a plurality of recesses and a first longitudinal axis. The inner gerotor is located radially inwardly of the outer gerotor and includes: a plurality of lobes; a cylindrically-shaped central opening; and a radially inner surface radially bounding the central opening. The crankshaft passes through the central opening and includes: an axis of rotation co-linear with the first longitudinal axis; and a second longitudinal axis not co-linear withthe axis of rotation. The inlet cover assembly includes a plurality of inlet ports. The outlet cover assembly includes a plurality of outlet ports. The magnetic actuators are circumferentially disposed about the outer gerotor. Each magnetic actuator included in the plurality of magnetic actuators includes: a respective magnetic core, separate from the outer gerotor and fixedly connected to the outer gerotor; and a respective winding disposed about the respective core. The magnetic actuators are arranged to be energized in sequence to create magnetic fields. The magnetic fields are arranged to displace the inner gerotor, with respect to the axis of rotation, to displace the plurality of lobes: out of the plurality of recesses, to draw fluid through the plurality of inlet ports, into the plurality of recesses; and into the plurality of recesses to expel the fluid out of the plurality of recesses and through the plurality of outlet ports.

According to aspects illustrated herein, there is provided a pump, including: an inner gerotor; a cylindrical crankshaft; an outer gerotor; an inlet shutter plate; an inlet cover assembly; an outlet shutter plate; an outlet cover assembly; and magnetic actuators. The inner gerotor includes: a plurality of lobes; and a central opening. The cylindrical crankshaft: includes an axis of rotation; and passes through the central opening. The outer gerotor is located radially outwardly of the inner gerotor and includes a plurality of recesses. The inlet cover assembly includes a plurality of inlet ports. The outlet cover assembly includes a plurality of outlet ports. The magnetic actuators are circumferentially disposed about the outer gerotor. The inlet shutter plate: is non-rotatably connected to the crankshaft; and axially disposed between the inner gerotor and the inlet cover assembly. The outlet shutter plate: is non-rotatably connected to a second axial end of the crankshaft; and is axially disposed between the inner gerotor and the outlet cover assembly. The magnetic actuators are arranged to be energized in sequence to create magnetic fields. The magnetic fields are arranged to displace the inner gerotor, with respect to the axis of rotation, to displace the plurality lobes out of the plurality of recesses, to draw fluid through the plurality of inlet ports, into the plurality of recesses; and into the plurality of recesses to expel the fluid out of the plurality of recesses and through the plurality of outlet ports. The plurality of inlet ports is at a radial distance from the axis of rotation. A line, parallel to the axis of rotation, passes through inlet shutter plate and the outlet shutter plate at the radial distance from the axis of rotation.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 12:
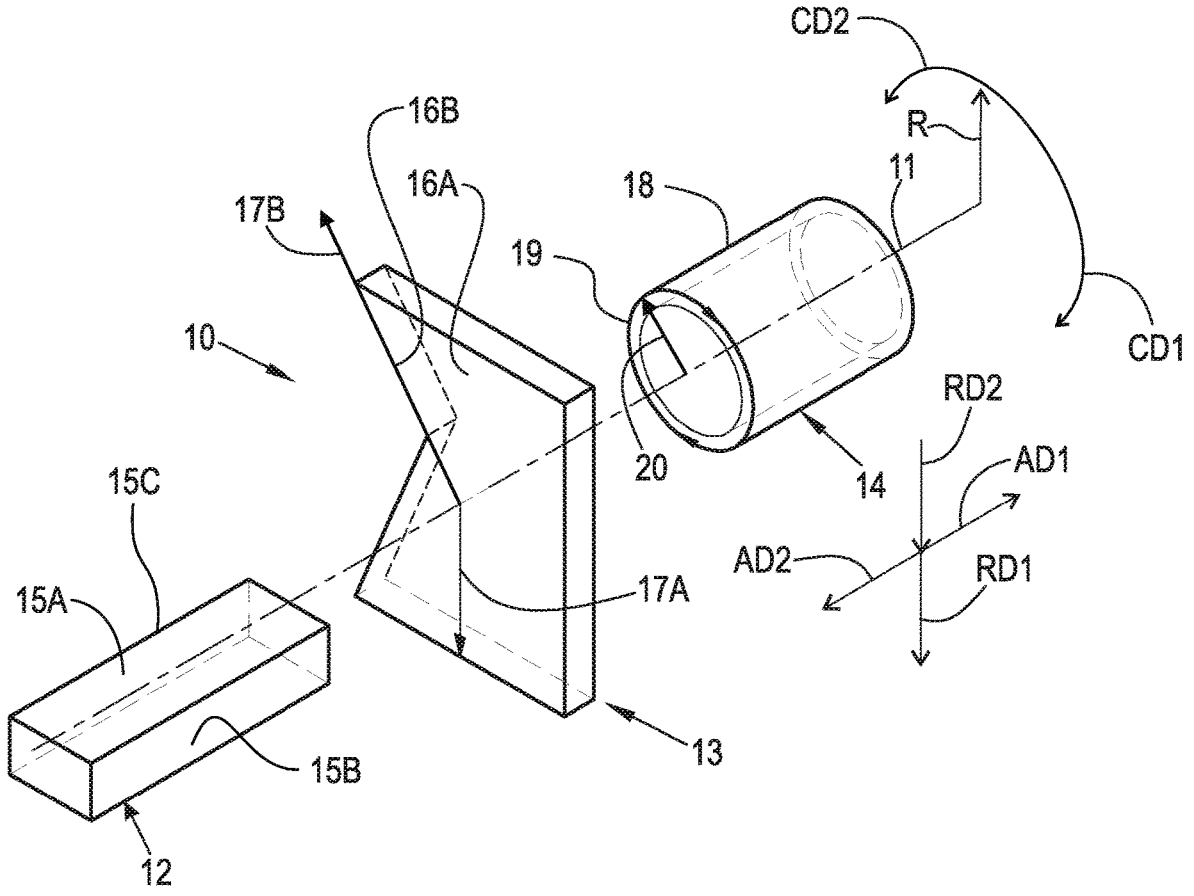
FIG. 12 is a perspective view of a cylindrical coordinate system demonstrating spatial terminology used in the present application.

FIG. 12 is a perspective view of cylindrical coordinate system 10 demonstrating spatial terminology used in the present application. The present application is at least partially described within the context of a cylindrical coordinate system. System 10 includes axis of rotation, or longitudinal axis, 11, used as the reference for the directional and spatial terms that follow. Opposite axial directions AD1 and AD2 are parallel to axis 11. Radial direction RD1 is orthogonal to axis 11 and away from axis 11. Radial direction RD2 is orthogonal to axis 11 and toward axis 11. Opposite circumferential directions CD1 and CD2 are defined by an endpoint of a particular radius R (orthogonal to axis 11) rotated about axis 11, for example clockwise and counterclockwise, respectively.

To clarify the spatial terminology, objects 12, 13, and 14 are used. As an example, an axial surface, such as surface 15A of object 12, is formed by a plane co-planar with axis 11. However, any planar surface parallel to axis 11 is an axial surface. For example, surface 15B, parallel to axis 11 also is an axial surface. An axial edge is formed by an edge, such as edge 15C, parallel to axis 11. A radial surface, such as surface 16A of object 13, is formed by a plane orthogonal to axis 11 and co-planar with a radius, for example, radius 17A. A radial edge is co-linear with a radius of axis 11. For example, edge 16B is co-linear with radius 17B. Surface 18 of object 14 forms a circumferential, or cylindrical, surface. For example, circumference 19, defined by radius 20, passes through surface 18.

Axial movement is in axial direction AD1 or AD2. Radial movement is in radial direction RD1 or RD2. Circumferential, or rotational, movement is in circumferential direction CD1 or CD2. The adverbs "axially," "radially," and "circumferentially" refer to movement or orientation parallel to axis 11, orthogonal to axis 11, and about axis 11, respectively. For example, an axially disposed surface or edge extends in direction AD1, a radially disposed surface or edge extends in direction RD1, and a circumferentially disposed surface or edge extends in direction CD1.

Figure 1:
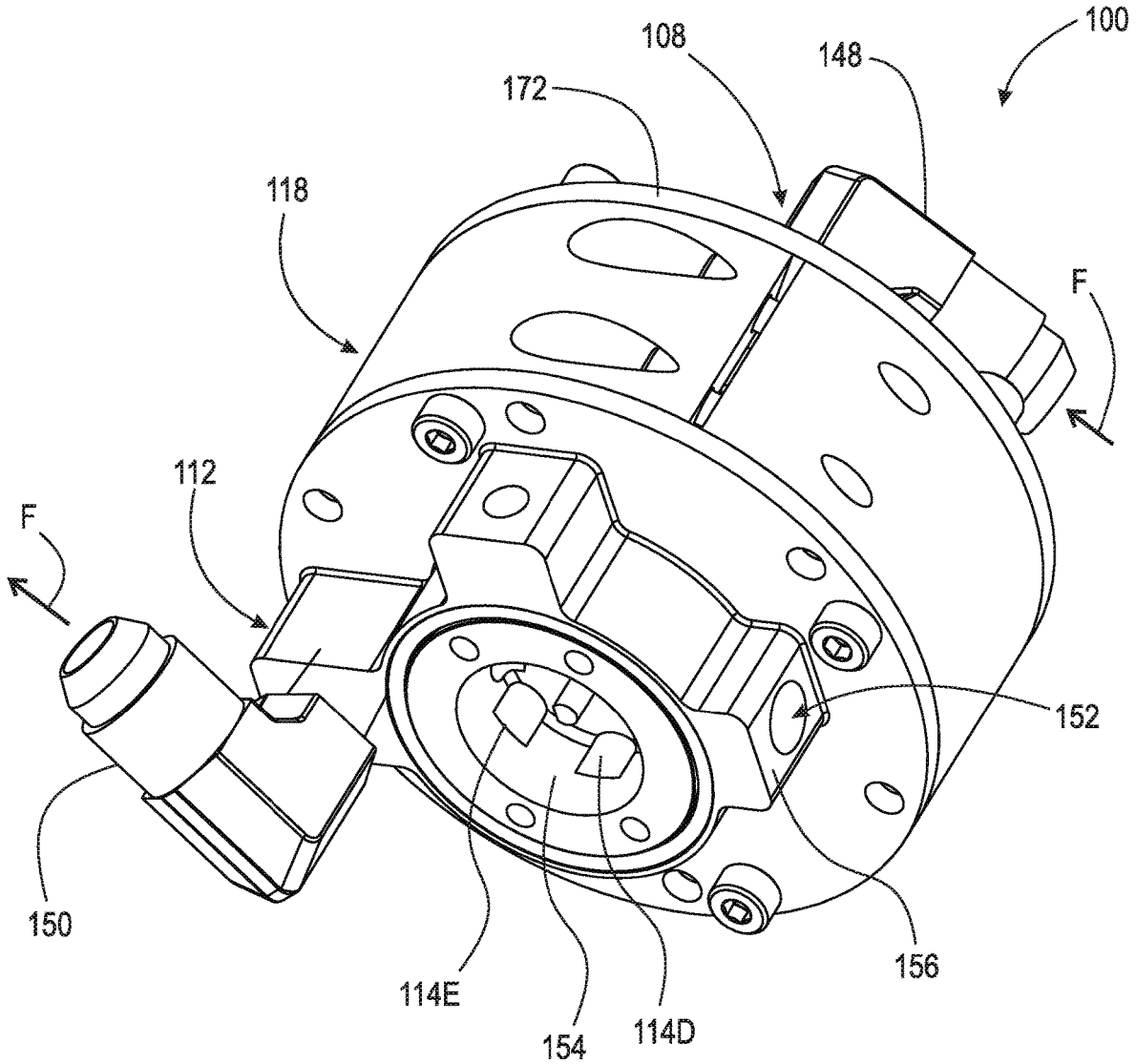
FIG. 1 is a front perspective view of an integrated eccentric motor and pump.

FIG. 1 is a front perspective view of integrated eccentric motor and pump 100.

Figure 2:
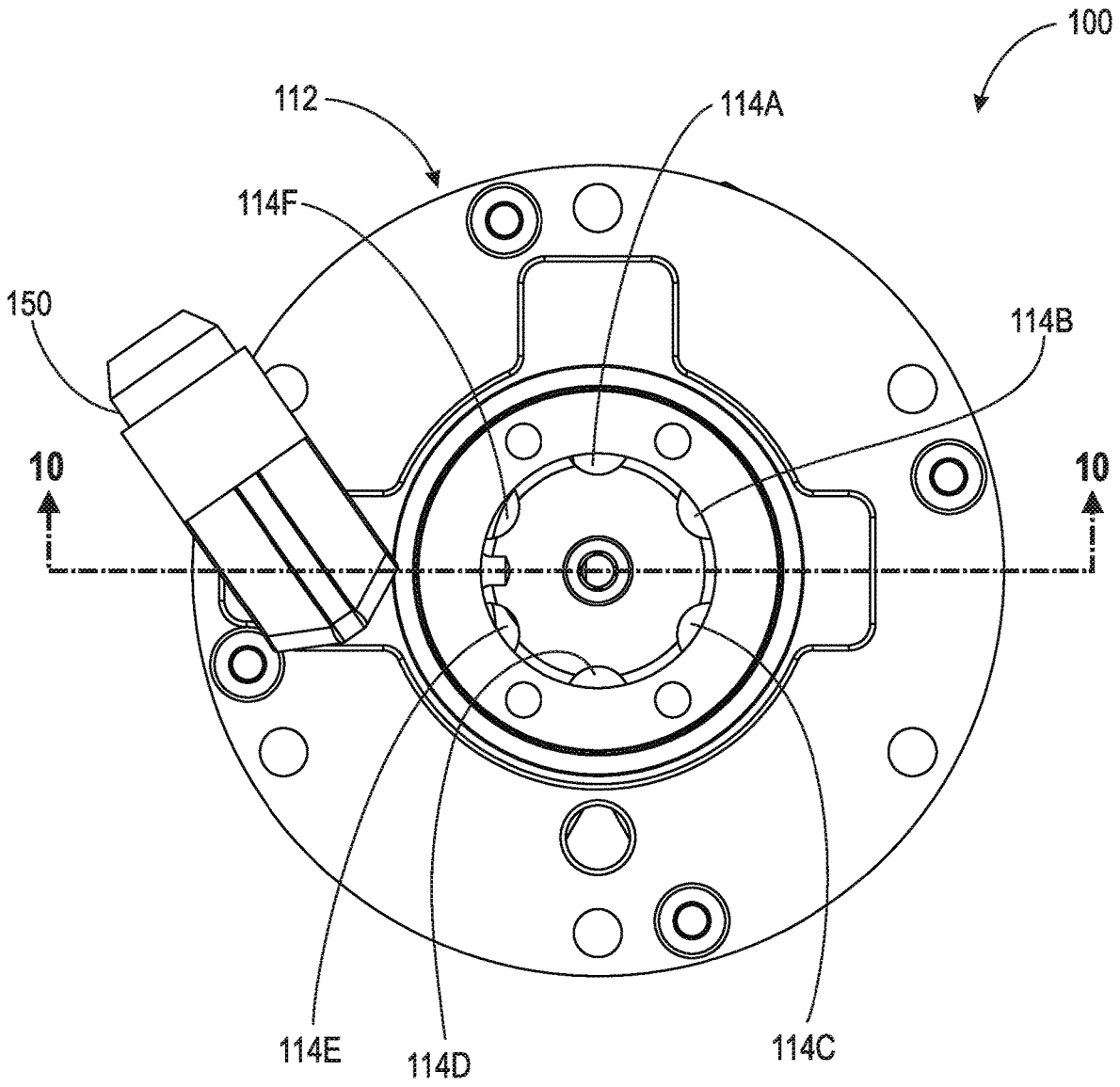
FIG. 2 is a front view of the integrated eccentric motor and pump shown in FIG. 1.

FIG. 2 is a front view of integrated eccentric motor and pump 100 shown in FIG. 1.

Figure 3:
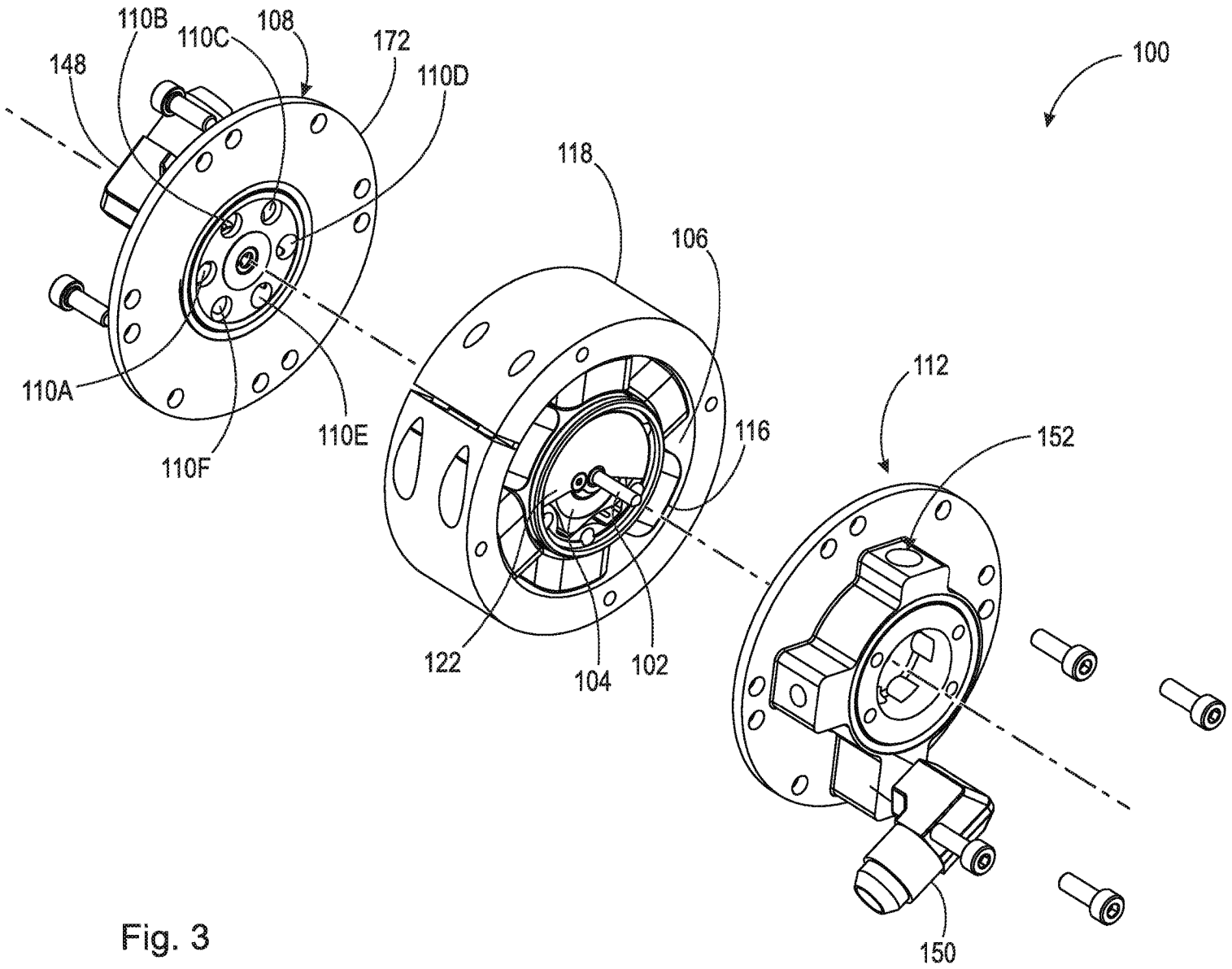
FIG. 3 is a front exploded view of the integrated eccentric motor and pump shown in FIG. 1.

FIG. 3 is a front exploded view of integrated eccentric motor and pump 100 shown in FIG. 1.

Figure 4:
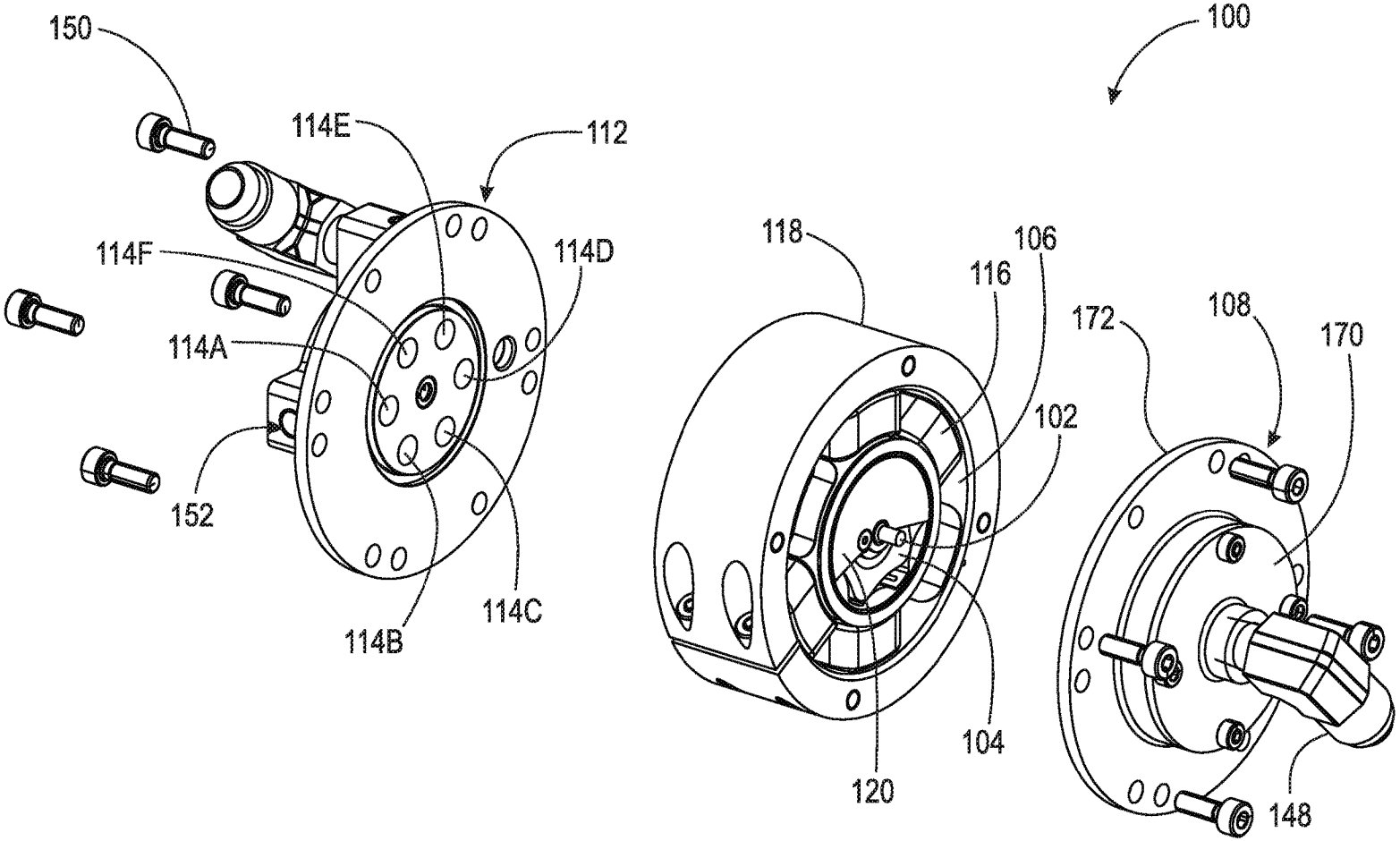
FIG. 4 is a back exploded view of the integrated eccentric motor and pump shown in FIG. 1.

FIG. 4 is a back exploded view of integrated eccentric motor and pump 100 shown in FIG. 1.

Figure 5:
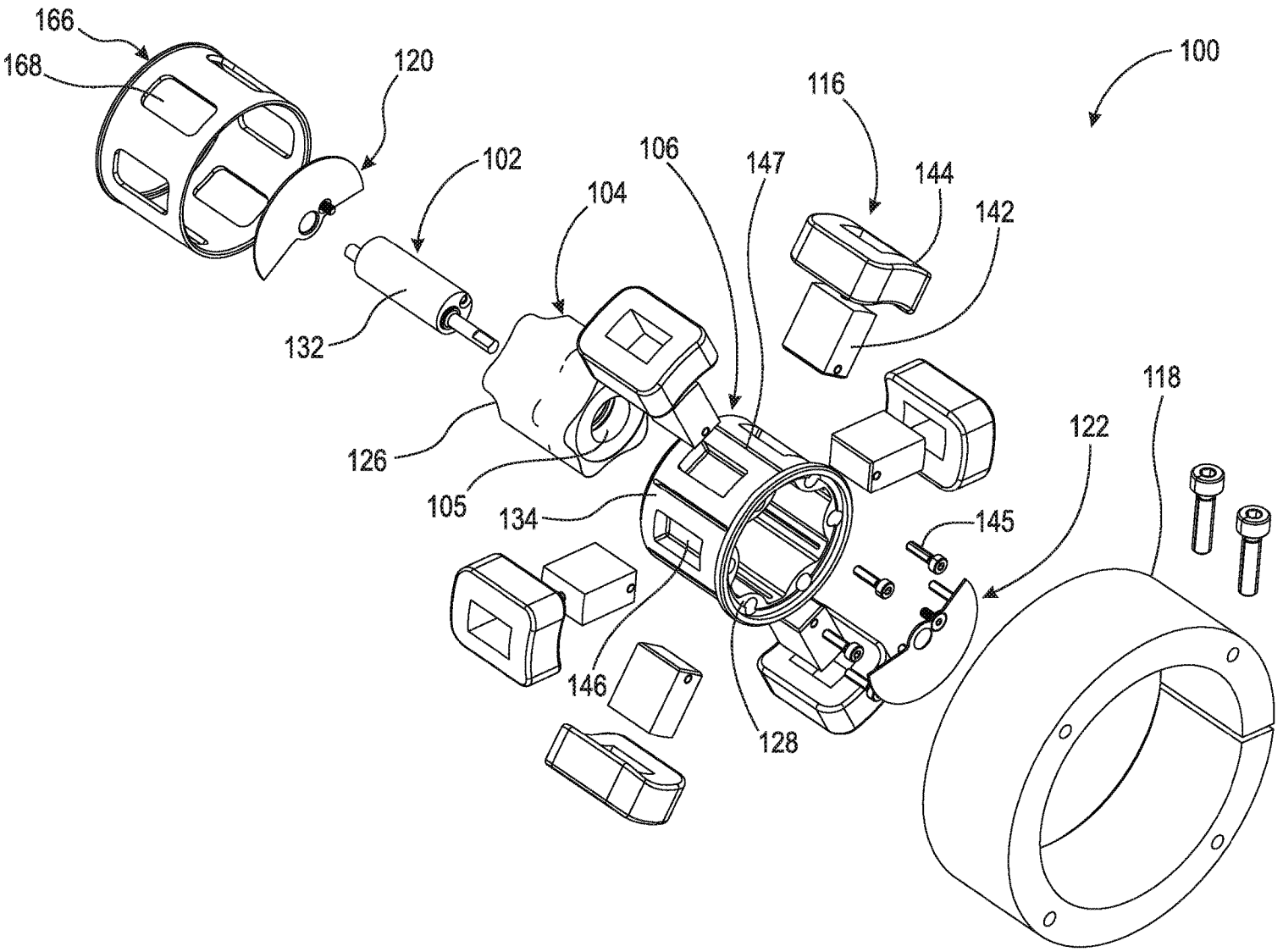
FIG. 5 is a front exploded view of the integrated eccentric motor and pump shown in FIG. 1.

FIG. 5 is a front exploded view of integrated eccentric motor and pump 100 shown in FIG. 1.

Figure 6:
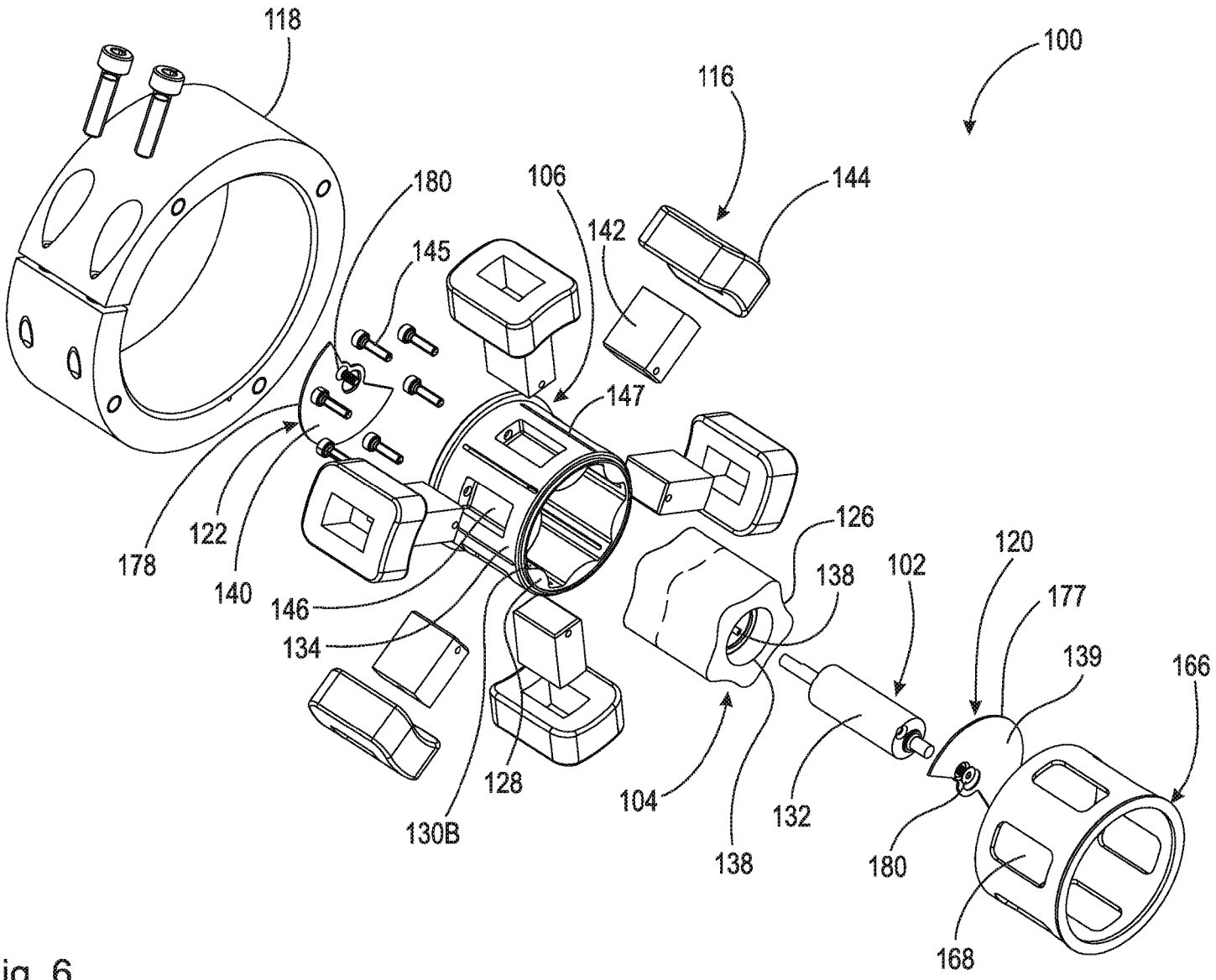
FIG. 6 is a back exploded view of the integrated eccentric motor and pump shown in FIG. 1.

FIG. 6 is a back exploded view of the integrated eccentric motor and pump 100 shown in FIG. 1.

Figure 7:
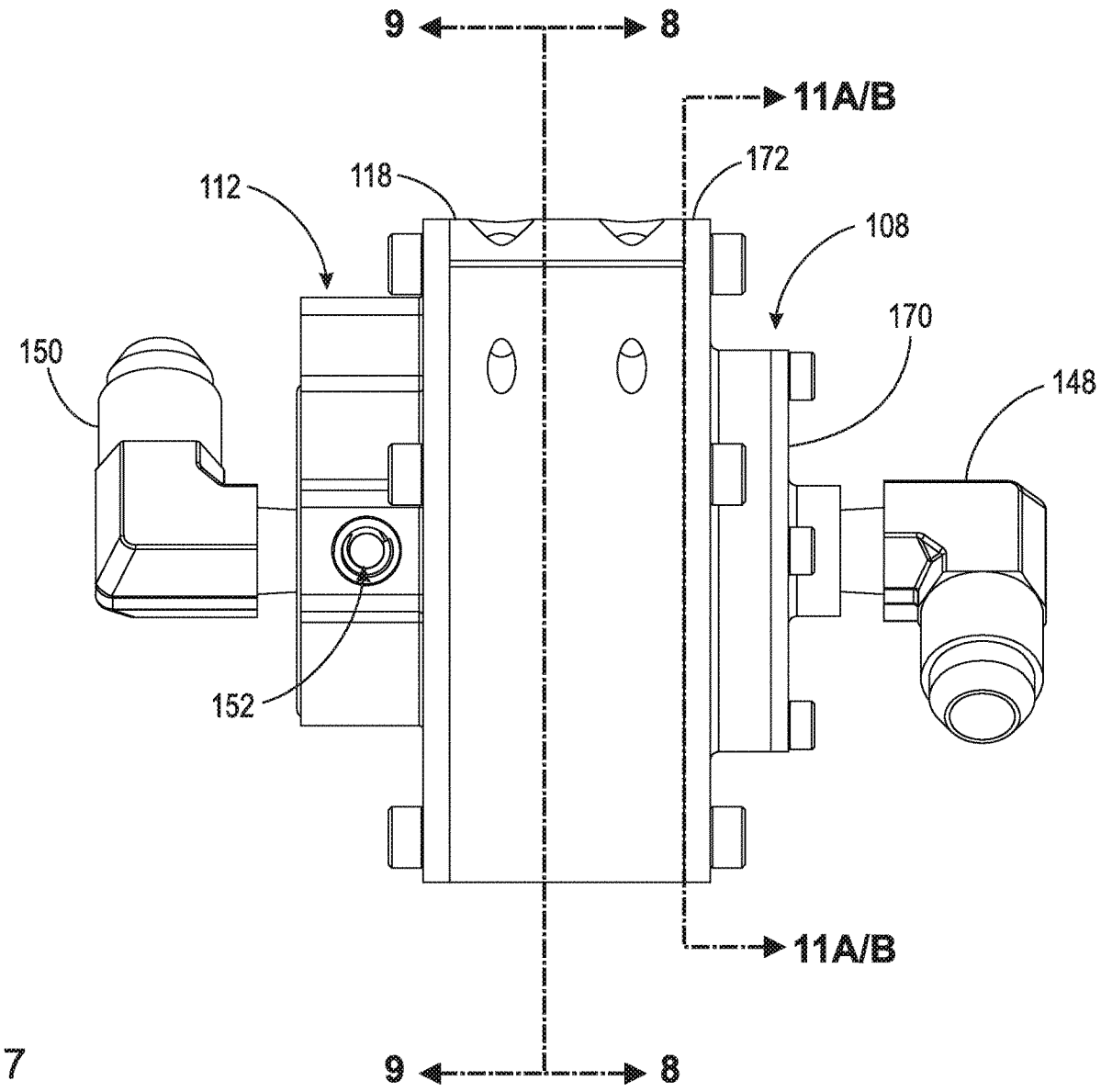
FIG. 7 is a side view of the integrated eccentric motor and pump shown in FIG. 1.

FIG. 7 is a side view of integrated eccentric motor and pump 100 shown in FIG. 1.

Figure 8:
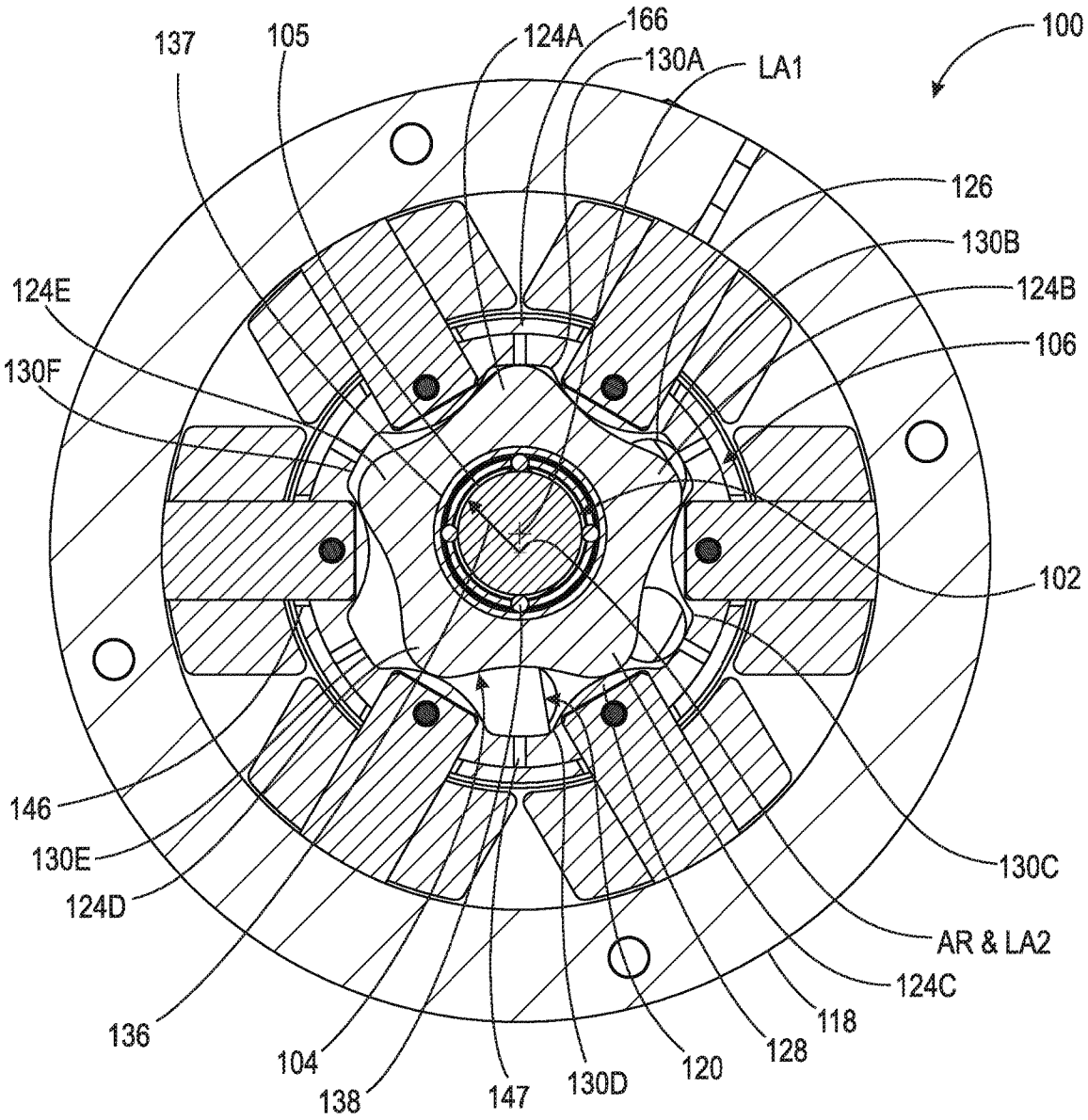
FIG. 8 is a cross-sectional view generally along line 8-8 in FIG. 7.

FIG. 8 is a cross-sectional view generally along line 8-8 in FIG. 7.

Figure 9:
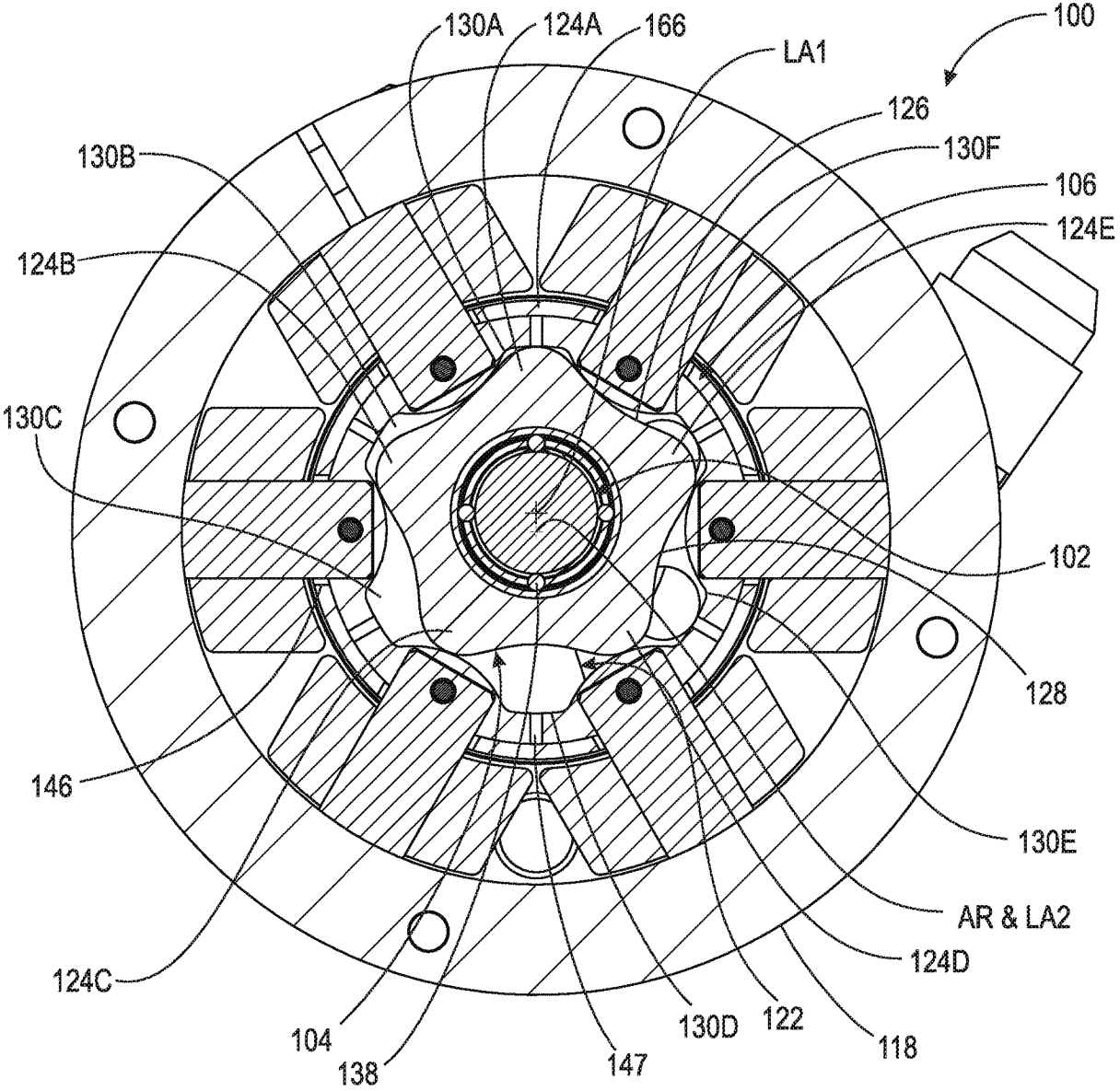
FIG. 9 is a cross-sectional view generally along line 9-9 in FIG. 7.

FIG. 9 is a cross-sectional view generally along line 9-9 in FIG. 7.

Figure 10:
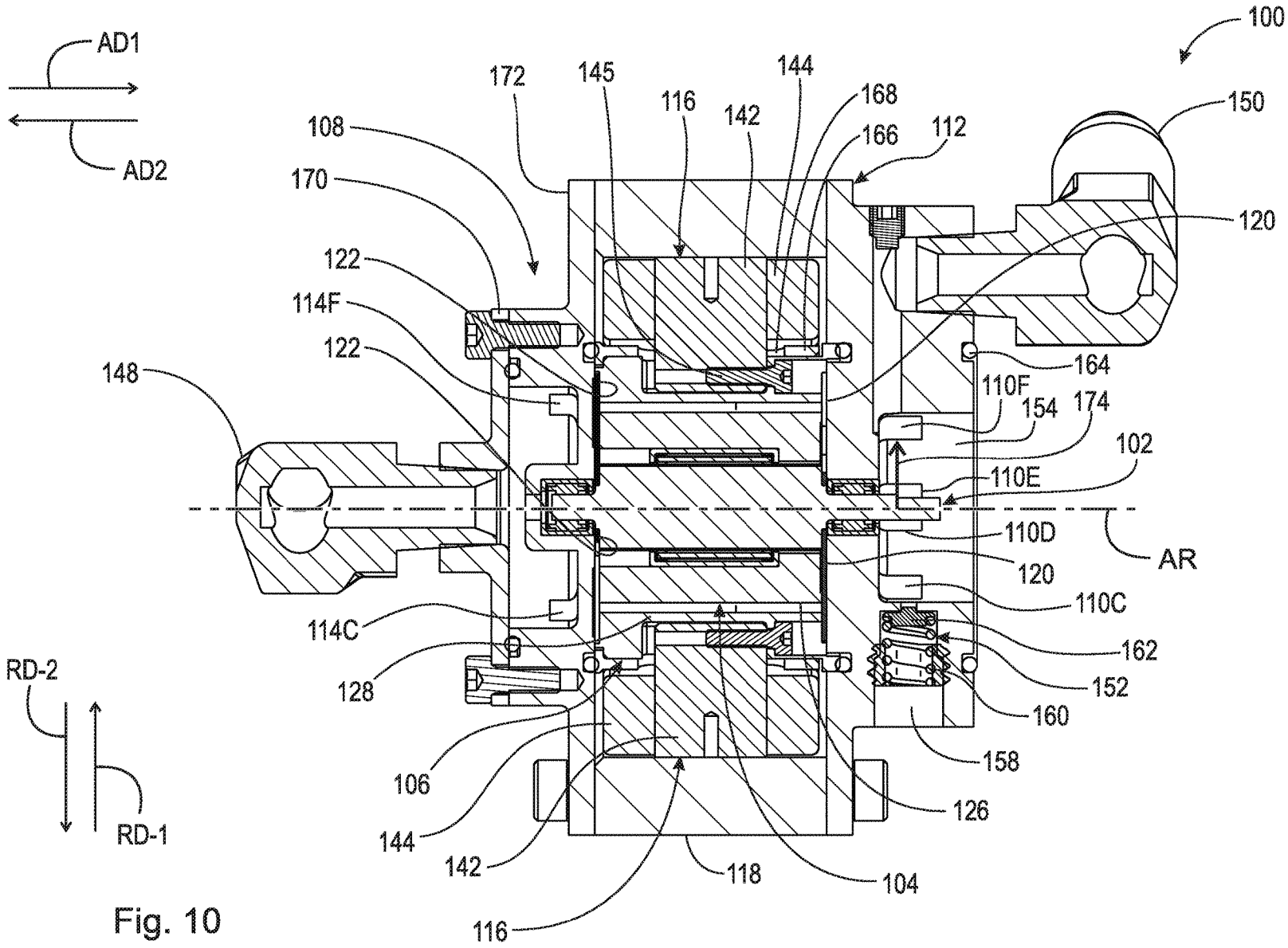
FIG. 10 is a cross-sectional view generally along line 10-10 in FIG. 2.

FIG. 10 is a cross-sectional view generally along line 10-10 in FIG. 2. The following should be viewed in light of FIGS. 1 through 10. Assembly 100 includes: cylindrical crankshaft 102; inner gerotor 104 with central opening 105; outer gerotor 106; inlet cover assembly 108 with inlet ports 110, for example inlet ports 110A-110F; outlet cover assembly 112 with outlet ports 114, for example outlet ports 114A-114F; modular magnetic actuators 116; outer ring 118 radially disposed about actuators 116; inlet shutter plate 120 non-rotatably connected to crankshaft 102; and outlet shutter plate 122 non-rotatably connected to crankshaft 102. Inner gerotor 104, outer gerotor 106, and ring 118 are constructed of magnetic material, for example pure iron or iron alloys. By "non-rotatably connected" components, we mean that: the components are connected so that whenever one of the components rotates, all the components rotate; and relative rotation between the components is not possible. Radial and/or axial movement of non-rotatably connected components with respect to each other is possible, but not required. In general, a reference character "[digit][digit][digit][letter]" designates a specific example of an element labeled as "[digit][digit][digit]." For example, lobe 114A is a specific example from among outlet ports 114. In FIGS. 1 through 6, 8, and 9, end plate 121 has been intentionally omitted.

Crankshaft 102 passes through central opening 105 and is rotatable with respect to inner gerotor 104. Inner gerotor 104 is radially disposed between crankshaft 102 and outer gerotor 106. Inner gerotor 104 includes lobes 124, for example lobes 124A-124E and recesses 126. Each recess 126 is circumferentially located between a respective pair of lobes 124 from among 124A-124E. Outer gerotor 106 includes lobes 128 and recesses 130, for example recesses 130A-

130F. Each recess 130 from among recesses 130A-130F is circumferentially located between a respective pair of lobes 128. In the example of FIGS. 1 through 6, the number of lobes 124 is different from the number of recesses 130, for example, inner gerotor 104 includes five lobes 124 and outer gerotor includes six recesses 130. In an example embodiment, the number of lobes 124 is one less than the number of recesses 130.

As further described below, actuators 116 are arranged to be energized in sequence to create magnetic fields 131. Magnetic fields 131 are arranged to displace inner gerotor 104 with respect to axis of rotation AR to displace lobes 124: out of recesses 130 and draw fluid F through inlet ports 110 into the recesses 130; and into recesses 130 to expel fluid F out of the recesses 130 and through outlet ports 114. Actuators 116 can be energized by any means known in the art. For example, a computer for a vehicle housing pump 100 can be programmed to provide the sequential energizing using a power source for the vehicle.

In the example of FIG. 1: shaft 102 includes axis of rotation AR; shaft 102 and inner gerotor 104 include longitudinal axis LA1; and outer gerotor 106 includes longitudinal axis LA2. Shaft 102 and inner gerotor 104 are centered about axis LA1. Axis LA1 is referenced with respect to, or centered with respect to, cylindrical outer surface 132 of crankshaft 102 and radially inner surface 133 of inner gerotor 104. For example, surface 132 is at a same, or uniform, radial distance 134 from axis LA1. Longitudinal axis LA2 is referenced with respect to, or radially centered with respect to, radially outer surface 135 of outer gerotor 106. Axis AR and LA2 are co-linear. Axis LA1 is not co-linear with axis AR or axis LA2. For example, radial distance 136 from axis AR to surface 132 is not uniform. Thus, crankshaft 102 rotates eccentrically about axis AR.

In the example of FIG. 1: central opening 105 is bounded by radially inner surface 137 of inner gerotor 104; and pump 100 includes at least one bearing 138 disposed between and in contact with outer surface 134 and inner surface 137. Pump 100 includes bearings BR. A respective bearing BR is disposed in each of inlet cover assembly 108 and outlet cover assembly 112. Bearings 138 and BR enable rotation of crankshaft 102 with respect to inner gerotor 104.

Plates 120 and 122 rotate with crankshaft 102. Radially outer segment 139 of plate 120 is arranged to axially align with and block recesses 130 from inlet ports 110 to enable lobes 124 to expel fluid F from recesses 130 through outlet ports 114. Radially outer segment 140 of plate 122 is arranged to axially align with and block recesses 130 from outlet ports 114 to enable lobes 124 to draw fluid F into recesses 130 through inlet ports 110. Portions 139 and 140 axially overlap. The axial overlap of plates 120 and 122 is illustrated and further described in the discussion of FIGS. 11A and 11B below. Plates 120 and 122 are radially centered about axis AR.

Each magnetic actuator 116 includes: magnetic core 142, separate from outer gerotor 106 and fixedly connected to outer gerotor 106; and winding 144 disposed about core 142. In an example embodiment, each core 142 is fixed to gerotor 106 by a respective bolt 145. Cores 142 extend into pockets 146 in outer gerotor 106.

In an example embodiment, outer gerotor 106 includes slots 147. In an example embodiment, slots 147 extend past magnetic actuators 116 in axial direction AD-1 and axial direction AD-2, opposite axial direction AD-1. As further described below, magnetic fields 131 are generated by energizing circumferentially adjacent pairs of actuators 116. The magnetic fields 131 draw lobes 124A-124E into recesses 130A-130F to displace inner gerotor 104 eccentrically about axis AR. Slots 147 create air gaps forcing magnetic fields 131 across recesses 130A-130F and lobes 124A-124E, rather than by-passing recesses 130A-130F and flowing through outer gerotor 106.

In an example embodiment: inlet cover assembly 108 includes inlet nozzle 148; and outlet assembly 112 includes outlet nozzle 150. In an example embodiment, outlet cover assembly 112 includes pressure relief valve 152 and outlet chamber 154. In the example of FIG. 1, chamber 154 is bounded by assembly 112 and end plate 121. Valve 152 is open to chamber 154 and exterior 156 of assembly 112. In an example embodiment, valve 152 includes through-bore 158, and spring 160 and cap 162 both disposed in through-bore 158. Spring 160 urges cap 162 in radial direction RD-1 to seal through-bore 158. When assembly 100 is installed in a system, for example in a transmission, chamber 154 is sealed, for example by O-ring 164, except for outlet 150 and ports 114. Valve 152 protects assembly 100 from an over-pressure situation, for example if a blockage occurs downstream of outlet 150. For example, when fluid pressure in chamber 154 exceeds the force with which spring 160 urges cap 162 in direction RD-1, fluid F in chamber 154 displaces cap 162 in direction RD-2, opposite RD-1, to open through-bore 158 and enable fluid F to flow through through-bore 158 and out of chamber 154.

In an example embodiment, assembly 100 includes seal 166 radially disposed about outer gerotor 106 and including slots 168. Magnetic cores 142 extend through slots 168 into pockets 146 of outer gerotor 106. In an example embodiment, inlet cover assembly includes plates 170 and 172.

Figure 11A:
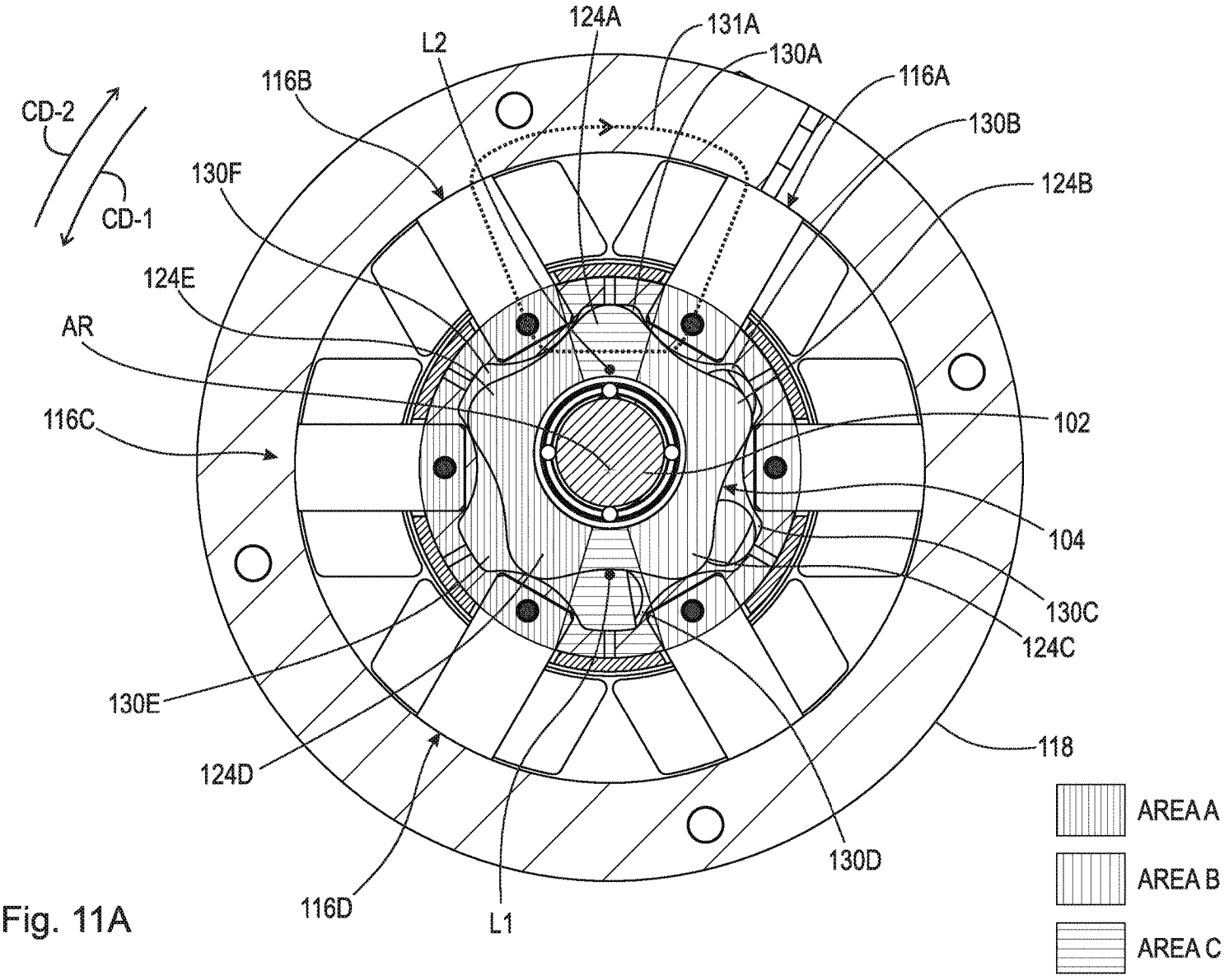
FIG. 11A is a cross-sectional view generally along line 11A/B-11A/B in FIG. 7.
Figure 11B:
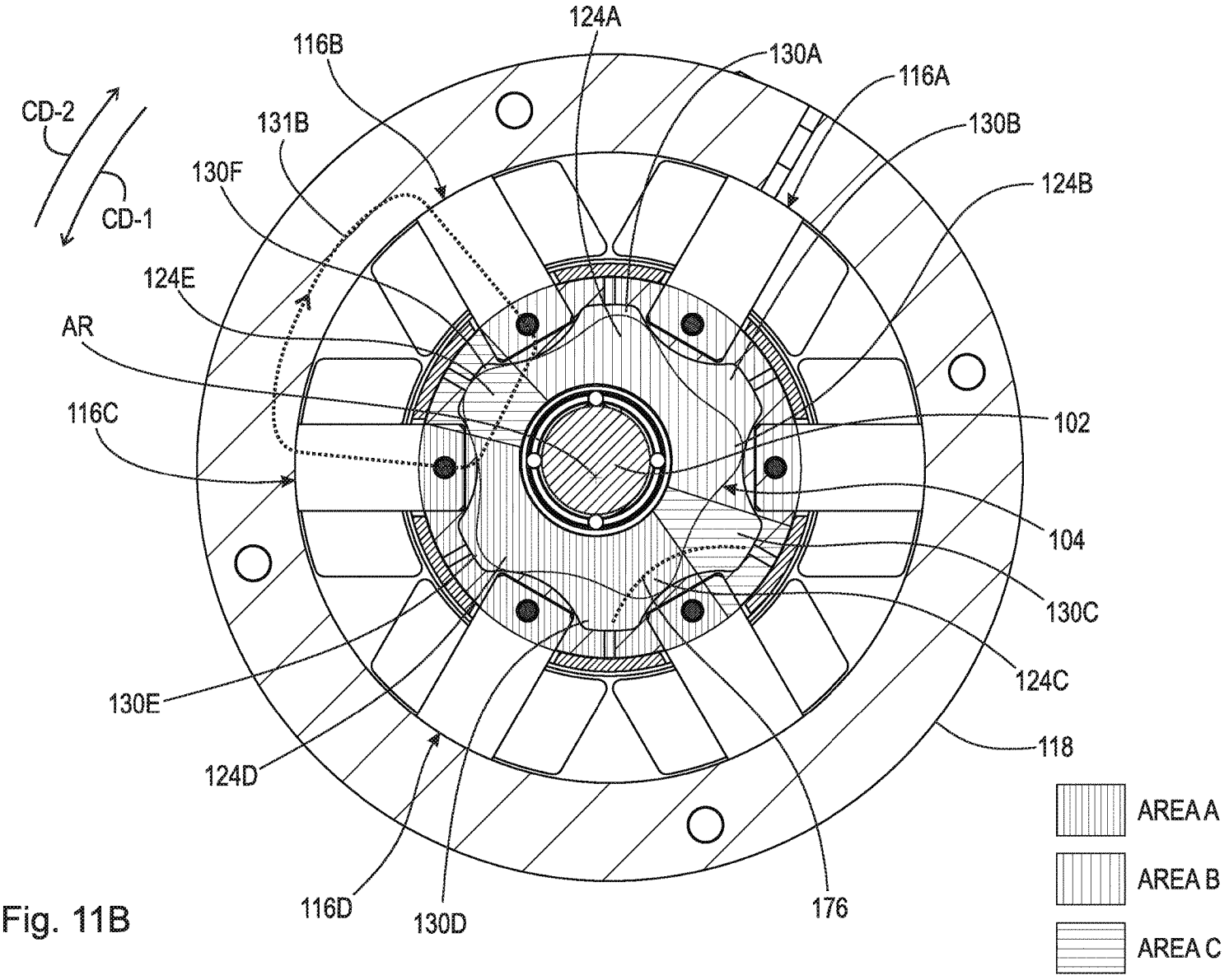
FIG. 11B is a cross-sectional view generally along line 11A/B-11A/B in FIG. 7.

FIGS. 11A and 11B are cross-sectional views generally along line 11A/B-11A/B in FIG. 7, illustrating operation of eccentric motor and pump assembly 100. The following should be viewed in light of FIGS. 1 through 11B and provides further detail regarding the structure and function of assembly 100. In FIGS. 11A and 11B: portions of inner gerotor 104 and outer gerotor 106 are covered by outlet shutter plate 122; and inner gerotor 104, outer gerotor 106, and outlet shutter plate 122 cover portions of inlet shutter plate 120 and inlet cover assembly 108. However, to illustrate the relative circumferential positions of inner gerotor 104 and inlet shutter plate 120: area A designates the segment of portion 139 not axially overlapping portion 140; area B designates the segment of portion 140 not axially overlapping portion 139; and areas C illustrate axially overlapping segments of portions 139 and 140.

As noted above, plates 120 and 122, in particular, respective segments of portions 139 and 140, axially overlap. For example: inlet ports 110 are at radial distance 174 from axis of rotation AR; and lines L1 and L2, parallel to axis of rotation AR, passes inlet shutter plate 120 and outlet shutter plate 122 in areas C at radial distance 141 from axis of rotation AR.

In FIGS. 11A and 11B: pairs of actuators 116 are being sequentially activated to eccentrically: displace inner gerotor 104 in circumferential direction CD-2, opposite direction CD-1, with respect to axis AR; and simultaneously, displace respective portions of inner gerotor 104 in opposite radial directions RD-1 and RD-2. Fluid F is drawn through one of inlet ports 110A-110F and into one of recesses 130A-130F when: shutter plate 120 is not blocking the one of inlet ports 11A-110F and the one of recesses 130A-130F; shutter plate 122 is blocking the one of recesses 130A-130F; and one of lobes 124A-124E displaces out of the one of recesses 130A-130F in direction CD-2, causing a vacuum in the one of recesses 130A-130F, which draws fluid F into the one of recesses 130A-130F.

Fluid F is expelled out of one of recesses 130A-130F and through one of outlet ports 114A-114F when: shutter plate 122 is not blocking the one of recesses 130A-130F or the one of outlet ports 114A-114F; shutter plate 120 is blocking the one of recesses 130A-130F; and one of lobes 124A-124E displaces into the one of recesses 130A-130F in direction CD-2, forcing fluid F out of the one of recesses 130A-130F and through the one of outlet ports 114A-114F.

In FIG. 11A, actuators 116A and 116B have been oppositely energized to create magnetic field 131A passing through recess 130A and ring 118. Note that magnetic field 131A is schematically shown in FIG. 11A. Magnetic field 131A has drawn lobe 124A into recess 130A, displacing lobe 124A in directions RD-1 and CD-2. Note that lobe 124C has been displaced in directions RD-2 and CD-1. Drawing lobe 124A into recess 130A completes the expulsion of fluid F from recess 130A. The displacement of inner gerotor 104 has rotated crankshaft 102, input shutter plate 120, and output shutter plate 122 in direction CD-1 such that: most of recess 130A is blocked by shutter plates 120 and 122; recess 130B is open to inlet port 1108 and is blocked by shutter 122; lobe 124B has drawn fluid F into recess 130B; recess 130C is blocked by shutter plate 122, is open to inlet port 114C, and contains fluid F; most of recess 130D is blocked by plates 120 and 122 and contains fluid F; recess 130E is blocked by shutter plate 120, is open to outlet port 114E, and contains fluid F; and recess 130F is blocked by shutter plate 120, is open to outlet port 114F, and contains fluid F.

In FIG. 11B, actuators 116B and 116C have been oppositely energized to create magnetic field 131B passing through recess 130F and ring 118. Magnetic field 131B has drawn lobe 124E into recess 130F, displacing lobe 124E in directions RD-1 and CD-2. Note that lobe 1248 has been displaced in directions RD-2 and CD-1. Drawing lobe 124E into recess 130F completes the expulsion of fluid F from recess 130F. The displacement of inner gerotor 104 has rotated crankshaft 102, input shutter plate 120, and output shutter plate 122 in direction CD-1 such that: recess 130A is open to inlet port 110A and is blocked by output shutter 122; lobe 124A has drawn fluid F into recess 130A; recess 130B is open to inlet port 110B, is blocked by shutter 122, and contains fluid F; most of recess 130C is blocked by shutter plates 120 and 122 and contains fluid F; recesses 130D and 130E are open to outlet ports 114D and 114E, respectively, are blocked by inlet shutter plate 120, and contain fluid F; and most of recess 130F is blocked by shutter plates 120 and 122.

Once lobe 124E is fully disposed in recess 130F, the above sequence is continued. For example: magnetic actuators 116C and 116D are oppositely energized to create a magnetic field through recess 130E, drawing lobe 124D into recess 130E in directions RD-1 and CD-2; shutter plates 120 and 122 continue to rotate in direction; lobe 124D expels fluid F from recess 130E through outlet port 114E; and lobe 124E draws fluid F into recess 130F through inlet port 110F. In like manner, pairs of adjacent magnetic actuators 116 are oppositely energized to rotate gerotor 104 in direction CD2 while shutter plates 120 and 122 continue to rotate in direction CD-1, providing a continuous cycle of recesses 130A-130F being filled with fluid F and fluid F being expelled from recesses 130A-130F.

The following provides further detail regarding the operation of pump 100. As noted above, the sequential energizing of circumferentially adjacent actuators 116 in direction CD-1 displaces inner gerotor 104 in directions CD-2, RD-1 and RD-2. Thus, inner gerotor does not rotate about axis AR in a circular path in direction CD-1. Path of motion 176 for lobe 124C from recess 130C to recess 130D illustrates the eccentric displacement of inner gerotor 104. Path 176 includes motion in direction CD-1 as well as motion in directions RD-1 and RD-2. Therefore, in the example of pump 100, the eccentric displacement of inner gerotor 104 rotates crankshaft 102 a full revolution about axis AR for every completion of a cycle by a lobe 124. Thus, in the time that inner gerotor 104 displaces 60 degrees (360 degrees divided by the number of recesses 130) as illustrated by path 176, crankshaft 102 completes a full rotation about axis AR.

The relative speeds of crankshaft 102 (and plates 120 and 122) and inner gerotor 104 result in an efficient timing for pump 100. For example: shutter plate 120 begins to rotate past an inlet port 110, which plate 120 had been blocking, to open the inlet port 110 as a lobe 124 begins to lift from a recess 130 axially aligned with the inlet port; and shutter plate 122 begins to rotate past an outlet port 114, which plate 122 had been blocking, to open the outlet port 114 as a lobe 124 begins to displace into a recess 130 axially aligned with the outlet port.

As noted above, for a known integrated eccentric motor and pump, the eccentric rotation of the rotor results in a normal force that can create a locking-load condition that can jam an inlet guide and/or an outlet guide against a stator, blocking rotation of the rotor. Pump 100 eliminates this problem by: by centering outer circumferences 177 and 178 of shutter plates 120 and 122, respectively, about axis AR and LA1 (rather than about axis LA2) and driving plates 120 and 122 with bolts 180. Bolts 180 are proximate the inner diameters of plates 120 and 122 and fixedly attach plates 120 and 122 to crankshaft 102. Thus, the load forces associated with rotation of plates 120 and 122 are carried by bearings 140 and are resolved to purely tangential forces, instead of normal forces.

As noted above, for a known integrated eccentric motor and pump, a single electrical winding is energized to draw a protrusion into a space to rotate the rotor. However, pump 100 energizes two actuators 116 at a time to create a much stronger magnetic field 131 to draw lobes 124 into recesses 130. Thus, the operation of pump 100 is more robust and reliable.

As noted above, for a known integrated eccentric motor and pump, it is difficult to assemble the integral electrical windings, and the spaces are not fully sealed, enabling fluid from the pump to bathe the windings. However, magnetic actuators 116 for pump 100 are modular units separate from the outer gerotor. Thus, complicated wiring operations about the structure of the outer gerotor are eliminated. As well: cores 142 are housed in pockets 146, isolated from recesses 130; and seal 166 seals the radially outer ends of slots 147. Therefore, fluid F cannot reach actuators 116, preventing degradation of actuators 116 due to exposure to fluid F and increasing efficiency of pump 100 by reducing pressure loss through leakage of fluid F from recesses 130. Further, the modularity of actuators 116 enables the characteristics of magnetic fields 131 to be easily varied.

As noted above, for a known integrated eccentric motor and pump, there is no restriction to the physical travel path of the rotor, enabling the rotor to unpredictably react to magnetic or shock load to the pump. However, the presence of crankshaft 102 and bearings 140 more precisely define the motion path of inner gerotor 104, enabling smoother and more predictable operation. Pump 100 also includes pressure relief valve 152 in outlet cover assembly 112, which prevents an over-pressure condition at outlet ports 114 that could damage pump 100.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE CHARACTERS

10 cylindrical system
11 axis of rotation
AD1 axial direction
AD2 axial direction
RD1 radial direction
RD2 radial direction
CD1 circumferential direction
CD2 circumferential direction
R radius
12 object
13 object
14 object
15A surface
15B surface
15C edge
16A surface
16B edge
17A radius
17B radius
18 surface
19 circumference
20 radius
AD-1 axial direction
AD-2 axial direction
AR axis of rotation, crankshaft
BR bearing
CD-1 circumferential direction
CD-2 circumferential direction
F fluid
L1 line
L2 line
LA1 longitudinal axis, crankshaft
LA2 longitudinal axis, outer gerotor
RD-1 radial direction
RD-2 radial direction
100 eccentric motor and pump assembly
102 crankshaft
104 inner gerotor
105 central opening, inner gerotor
106 outer gerotor
108 inlet cover assembly
110A-110F inlet port
112 outlet cover assembly
114A-114F outlet port
116 magnetic actuator
118 outer ring
120 inlet shutter plate
121 end plate
122 outlet shutter plate
124A-124F lobes, inner gerotor
126 recess, inner gerotor
128 lobe, outer gerotor
130A-130F recesses, outer gerotor
131 magnetic field
131A magnetic field
131B magnetic field
132 cylindrical outer surface, crankshaft
133 radially inner surface, inner gerotor
134 radial distance
135 radially outer surface, outer gerotor
136 radial distance
138 bearing
139 radially outer portion, inlet shutter plate
140 radially outer portion, outlet shutter plate
142 magnetic core
144 winding
145 bolt
146 pocket, outer gerotor
147 slot, outer gerotor
148 inlet nozzle
150 outlet nozzle
152 pressure relief valve
154 outlet chamber
156 exterior, assembly 112
158 through-bore
160 spring
162 cap
164 O-ring
166 seal
168 slot
170 plate
172 plate
174 radial distance
176 path of motion
177 radially outer edge, inlet shutter plate
178 radially outer edge, outlet shutter plate
180 bolts

The invention claimed is:

1. A pump, comprising:
an inner gerotor including:
a plurality of lobes; and,
a central opening;
a crankshaft:
passing through the central opening;
rotatable about an axis of rotation; and,
including a first longitudinal axis not co-linear with the axis of rotation;
an outer gerotor located radially outwardly of the inner gerotor and including:
a plurality of recesses;
a radially outer surface; and,
a plurality of pockets extending radially inwardly from the radially outer surface;
at least one bearing disposed between the inner gerotor and the crankshaft;
an inlet cover assembly including a plurality of inlet ports;
an outlet cover assembly including a plurality of outlet ports; and,
a plurality of magnetic actuators, each magnetic actuator including a core extending radially inwardly into a respective pocket included in the plurality of pockets, wherein:
the at least one bearing enables relative rotation of the crankshaft with respect to the inner gerotor;
the plurality of magnetic actuators is arranged to be energized in a sequence to create magnetic fields; and,
the magnetic fields are arranged to displace the inner gerotor with respect to the axis of rotation:

to displace a first lobe, included in the plurality of lobes, out of a first recess, included in the plurality of recesses, and draw a fluid through a first inlet port, included in the plurality of inlet ports, into the first recess; and, to displace a second lobe, included in the plurality of lobes, into a second recess, included in the plurality of recesses, and expel the fluid out of the second recess and through a first outlet port included in the plurality of outlet ports.

2. The pump of claim 1, wherein:

the sequence is in a first circumferential direction;

the magnetic fields are arranged to displace the inner gerotor, with respect to the axis of rotation, in a second circumferential direction opposite the first circumferential direction; and, the displacement of the inner gerotor is arranged to rotate the crankshaft, with respect to the inner gerotor, in the first circumferential direction.

3. The pump of claim 1, wherein:

the sequence is in a first circumferential direction;

the magnetic fields are arranged to displace the inner gerotor with respect to the axis of rotation in:

a second circumferential direction opposite the first circumferential direction; and, at least one radial direction; and, the displacement of the inner gerotor is arranged to rotate the crankshaft, with respect to the inner gerotor, in the first circumferential direction.

4. The pump of claim 1, wherein:

the central opening of the inner gerotor is bounded by an inner surface of the inner gerotor;

the crankshaft includes a cylindrical outer surface; and, the at least one bearing is disposed between the inner surface and the cylindrical outer surface.

5. The pump of claim 1, further comprising:

an inlet shutter plate non-rotatably connected to the crankshaft and axially disposed between the inner gerotor and the inlet cover assembly; and, an outlet shutter plate:

non-rotatably connected to the crankshaft;

axially disposed between the inner gerotor and the outlet cover assembly; and, axially overlapping the inlet shutter plate, wherein:

the plurality of inlet ports is at a radial distance from the axis of rotation; and, a line, parallel to the axis of rotation, passes through the inlet shutter plate and the outlet shutter plate at the radial distance from the axis of rotation.

6. The pump of claim 5, wherein:

as the first lobe is displaced out of the first recess, the outlet shutter plate is arranged to block an axial end of the first recess; and, as the second lobe is displaced into the second recess, the inlet shutter plate is arranged to block an axial end of the second recess.

7. The pump of claim 5, wherein:

the inlet shutter plate includes a radially outer edge:

disposed radially outwardly beyond the plurality of inlet ports; and, radially centered about the axis of rotation; and, the outlet shutter plate includes a radially outer edge:

disposed radially outwardly beyond the plurality of outlet ports; and, radially centered about the axis of rotation.

8. The pump of claim 1, wherein each magnetic actuator included in the plurality of magnetic actuators includes:

a respective magnetic core, separate from the outer gerotor and fixedly connected to the outer gerotor; and, a respective winding disposed about the respective core.

9. The pump of claim 1, wherein:

the plurality of lobes consists of a first number of lobes;

the plurality of recesses consists of a second number of recesses; and, the first number is different from the second number.

10. The pump of claim 1, wherein:

the plurality of magnetic actuators includes a first magnetic actuator and a second magnetic actuator circumferentially bracketing the second recess;

the first magnetic actuator and the second magnetic actuator are arranged to be simultaneously energized to generate a first magnetic field passing through the second recess; and, the first magnetic field is arranged to:

displace the first lobe out of the first recess; and displace the second lobe into the second recess.

11. The pump of claim 10, wherein the first magnetic field is arranged to displace the second lobe into the second recess.

12. The pump of claim 10, wherein:

the plurality of lobes includes a third lobe;

the plurality of recesses includes a third recess;

the plurality of magnetic actuators includes a third magnetic actuator;

the second magnetic actuator and the third magnetic actuator circumferentially bracket the third recess;

the second magnetic actuator and the third magnetic actuator are arranged to be simultaneously energized to generate a second magnetic field passing through the third recess; and, the second magnetic field is arranged to rotate the third lobe into the third recess to:

expel the fluid from the third recess and through a second outlet port, included in the plurality of outlet ports, into the third recess; and, displace the second lobe out of the second recess and draw the fluid into the second recess through a second inlet port included in the plurality of inlet ports.

13. The pump of claim 10, wherein:

the outer gerotor includes a slot:

extending past the plurality of magnetic actuators in first and second opposite axial directions;

circumferentially disposed between the first magnetic actuator and the second magnetic actuator; and, arranged to prevent the first magnetic field from passing through the outer gerotor.

14. The pump of claim 10, further comprising:

an outer ring:

radially disposed about the plurality of magnetic actuators; and, constructed of a magnetic material, wherein the first magnetic field passes through the outer ring, the second recess, and the second lobe.

15. The pump of claim 1, wherein:

the outlet cover assembly bounds, at least in part, an outlet chamber;

the plurality of outlet ports opens to the outlet chamber; and, the outlet cover assembly includes a pressure relief valve open to the outlet chamber and an exterior of the outlet cover assembly.

16. A pump, comprising:
an outer gerotor including a plurality of recesses and a first longitudinal axis;
an inner gerotor located radially inwardly of the outer gerotor and including:
a plurality of lobes;
a cylindrically-shaped central opening; and,
a radially inner surface radially bounding a central opening
a cylindrical crankshaft passing through the central opening and including:
an axis of rotation co-linear with the first longitudinal axis; and,
a second longitudinal axis not co-linear with the axis of rotation;
at least one bearing disposed between the inner gerotor and the cylindrical crankshaft;
an inlet cover assembly including a plurality of inlet ports;
an outlet cover assembly including a plurality of outlet ports; and,
a plurality of magnetic actuators circumferentially disposed about the outer gerotor, each magnetic actuator included in the plurality of magnetic actuators including:
a respective magnetic core, separate from the outer gerotor and fixedly connected to the outer gerotor; and,
a respective winding disposed about the respective core, wherein:
the at least one bearing enables relative rotation of the cylindrical crankshaft with respect to the inner gerotor;
the plurality of magnetic actuators is arranged to be energized in sequence to create magnetic fields; and,
the magnetic fields are arranged to displace the inner gerotor, with respect to the axis of rotation, to displace the plurality of lobes:
out of the plurality of recesses, to draw fluid through the plurality of inlet ports, into the plurality of recesses; and,
into the plurality of recesses to expel the fluid out of the plurality of recesses and through the plurality of outlet ports.

17. The pump of claim 16, further comprising:
an inlet shutter plate:
non-rotatably connected to the crankshaft;
axially disposed between the inner gerotor and the inlet cover assembly; and,
including a first radially outer edge:
disposed radially outwardly beyond the plurality of inlet ports; and,
radially centered about the axis of rotation; and,
an outlet shutter plate:
non-rotatably connected to the crankshaft;
axially disposed between the inner gerotor and the outlet cover assembly; and,
including a second radially outer edge:
disposed radially outwardly beyond the plurality of outlet ports; and,
radially centered about the axis of rotation, wherein:
as the plurality of lobes is displaced out of the plurality of recesses, the outlet shutter plate is arranged to block first axial ends of the plurality of recesses from the plurality of outlet ports; and,
as the plurality of lobes is displaced into the plurality of recesses, the inlet shutter plate is arranged to block second axial ends of the plurality of recesses from the plurality of inlet ports.

18. The pump of claim 16, wherein:
the outlet cover assembly bounds an outlet chamber;
the plurality of outlet ports opens to the outlet chamber; and,
the outlet cover assembly includes a pressure relief valve open to the outlet chamber and an exterior of the outlet cover assembly.

19. A pump, comprising:
an inner gerotor including:
a plurality of lobes; and,
a central opening;
a cylindrical crankshaft:
including an axis of rotation; and,
passing through the central opening;
an outer gerotor located radially outwardly of the inner gerotor and including a plurality of recesses;
at least one bearing disposed between the inner gerotor and the cylindrical crankshaft;
an inlet cover assembly including a plurality of inlet ports;
an outlet cover assembly including a plurality of outlet ports;
a plurality of magnetic actuators circumferentially disposed about the outer gerotor;
an inlet shutter plate:
non-rotatably connected to the crankshaft; and,
axially disposed between the inner gerotor and the inlet cover assembly; and,
an outlet shutter plate:
non-rotatably connected the crankshaft; and,
axially disposed between the inner gerotor and the outlet cover assembly, wherein:
the at least one bearing enables relative rotation of the cylindrical crankshaft with respect to the inner gerotor;
the inlet shutter plate and the outlet shutter plate overlap, radially outwardly of the inner gerotor, in a direction parallel to the axis of rotation;
the plurality of magnetic actuators is arranged to be energized in sequence to create magnetic fields;
the magnetic fields are arranged to displace the inner gerotor, with respect to the axis of rotation, to displace the plurality of lobes:
out of the plurality of recesses, to draw fluid through the plurality of inlet ports, into the plurality of recesses; and,
into the plurality of recesses to expel the fluid out of the plurality of recesses and through the plurality of outlet ports;
the plurality of inlet ports is at a radial distance from the axis of rotation; and,
a line, parallel to the axis of rotation, passes through the inlet shutter plate and the outlet shutter plate at the radial distance from the axis of rotation.

20. The pump of claim 19, further comprising:
a plurality of magnetic actuators circumferentially disposed about the outer gerotor, each magnetic actuator included in the plurality of magnetic actuators including:
a respective magnetic core, separate from the outer gerotor and fixedly connected to the outer gerotor; and,
a respective winding disposed about the respective core, wherein:

the outer gerotor includes a first longitudinal axis co-linear with the axis of rotation; and, the crankshaft includes a second longitudinal axis not co-linear with the axis of rotation.

* * * * *